US009644462B2

(12) United States Patent
Green

(10) Patent No.: US 9,644,462 B2
(45) Date of Patent: May 9, 2017

(54) GAS LIFT ASSIST FOR FOSSIL FUEL WELLS

(71) Applicant: ABB Inc., Cary, NC (US)

(72) Inventor: John William Green, Bartlesville, OK (US)

(73) Assignee: ABB Inc., Cary, NC (US)

( * ) Notice: Subject to any disclaimer, the term of this patent is extended or adjusted under 35 U.S.C. 154(b) by 997 days.

(21) Appl. No.: 13/622,066

(22) Filed: Sep. 18, 2012

(65) Prior Publication Data

US 2013/0071262 A1 Mar. 21, 2013

Related U.S. Application Data

(60) Provisional application No. 61/536,224, filed on Sep. 19, 2011.

(51) Int. Cl.
*E21B 43/12* (2006.01)

(52) U.S. Cl.
CPC ..... *E21B 43/122* (2013.01)

(58) Field of Classification Search
CPC ..... E21B 43/121; E21B 43/122; E21B 43/123
See application file for complete search history.

(56) References Cited

U.S. PATENT DOCUMENTS

| | | | | |
|---|---|---|---|---|
| 4,738,313 | A | 4/1988 | McKee | |
| 5,634,522 | A | 6/1997 | Hershberger | |
| 6,595,294 | B1 | 7/2003 | Dalsmo et al. | |
| 6,633,236 | B2 | 10/2003 | Vinegar et al. | |
| 2002/0126021 | A1 | 9/2002 | Vinegar | |
| 2003/0121656 | A1* | 7/2003 | Hershberger | E21B 43/12 166/250.03 |
| 2004/0200615 | A1* | 10/2004 | Wilde | E21B 43/122 166/250.15 |
| 2009/0294123 | A1 | 12/2009 | Mescall et al. | |
| 2010/0042458 | A1 | 2/2010 | Rashid et al. | |
| 2010/0051267 | A1* | 3/2010 | Lowe | E21B 43/122 166/250.15 |

FOREIGN PATENT DOCUMENTS

| | | |
|---|---|---|
| CN | 201517406 | 6/2010 |
| WO | 0000715 A1 | 1/2000 |

OTHER PUBLICATIONS

Authorized Officer Annabel Grondin European Patent Office, Notification of Transmittal of the International Search Report and The Written Opinion of The International Searching Authority for International Application No. PCT/US2012/055890 having a mailing date of Oct. 24, 2013.

English Translation of Chinese Office Action; Chinese Patent Office; Chinese Patent Application No. 201410125552.5 dated Dec. 1, 2015, 12 pgs.

English Translation of Chinese Office Action, Chinese Appln. Serial No. 2016080901552490, dated Aug. 12, 2016, 6 pgs.

* cited by examiner

*Primary Examiner* — Brad Harcourt
(74) *Attorney, Agent, or Firm* — Taft Stettinius & Hollister LLP

(57) ABSTRACT

When a fossil fuel well is producing fossil fuel, lift gas injected into the well to bring the naturally occurring fluids in the well to the surface along with the fossil fuel and the plunger if the well has a plunger. An instrument is programmed to use the predetermined criteria to dynamically control the rate of injection of the lift gas into the well.

16 Claims, 11 Drawing Sheets

GAS LIFT ASSIST FOR FOSSIL FUEL WELLS

FIELD OF THE INVENTION

This invention relates to Fossil Fuel wells and more particularly to assisting in the 'deliquification' process of wells that contain fluids that must be removed either to allow the Fossil Fuel Gas well to continue to produce gas and/or produce the fluid which as is described below can be oil.

DESCRIPTION OF THE PRIOR ART

Fossil Fuel wells are generally limited in their production due to naturally occurring fluids that restrict the gas flow by accumulating in the production tubing.

Several forms of 'artificial lift' are used to remove these fluids. One such form of artificial lift is popularly known as "Plunger Lift" wherein a piece of steel or similar material known as a plunger is inserted into the tubing or tubing string of a wellbore. The tubing is the steel pipe used in drilling that resides within the steel pipe known as the casing. The casing separates the internal well bore from the earth. The tubing is used to produce natural gas and other byproducts such as oil, water and other condensates from geological formations under the ground surface. The plunger travels the length of the tubing to provide a physical interface between produced natural gas and any of the foregoing fluids that might be present within the tubing. Thus plunger lift is essentially a pneumatic piston that uses the well's own pressure systems to travel the tubing length to carry the liquids, that is, the fluids or fluid slugs to the surface.

Fossil Fuel wells with a low GOR (Gas to Oil Ratio) (Oil in this context can constitute any produced fluids), do not have sufficient energy to create a large enough differential pressure across the plunger and fluid slug in the tubing to cause the plunger and thus the fluid slug to rise to the surface.

SUMMARY OF THE INVENTION

A system provides lift gas to a well for producing fossil fuel. The well projects downwardly from a surface and has production tubing and a casing-tubing annulus. The system has:

gas lift injection piping connected to the casing-tubing annulus;

a first valve connected to the gas lift injection piping for injecting when the first valve is open the lift gas at a controlled rate into the gas lift injection piping to thereby produce the fossil fuel; and an instrument programmed to use a predetermined criteria to dynamically control the rate of injection of the lift gas into the gas lift injection piping.

An instrument for attachment to production tubing in a gas lift system for providing lift gas to a well for producing fossil fuel, the well also having a casing-tubing annulus, lift gas injection piping connected to the casing-tubing annulus, and a first valve connected to the gas lift injection piping for injecting the lift gas at a controlled rate into the gas lift injection piping, the instrument having:

program code usable by the instrument, the program code comprising:

code configurable to use a predetermined criteria to dynamically control the rate of injection of the lift gas into the gas lift injection piping when the well is producing the fossil fuel.

A method for injecting lift gas at a controllable rate into a fossil fuel well, the well having gas lift injection piping, production tubing and a control instrument with configurable code connected to the production tubing. In this method the control instrument is configured with a predetermined criteria that causes the instrument when the well is producing the fossil fuel to dynamically control the controllable rate at which the lift gas is injected into the gas lift injection piping.

DETAILED DESCRIPTION

There are shown and described herein a gas lift assist system that introduces certain amounts of 'Injection Gas' to a Fossil Fuel well system that has a plunger lift system to increase the differential pressure across the plunger and fluid slug. The injection gas which can be external natural gas or natural gas products, that is, gas lift gas, is injected into the wellbore through the casing/tubing annulus.

The increase in differential pressure arising from the introduction of the injection gas assists the plunger in its transition from the bottom of the wellbore to the top where the fluids are removed. As the well continues to produce natural gas, the naturally occurring fluids will eventually accumulate in the bottom of the wellbore, again causing the well to discontinue producing gas. The gas lift systems described herein can also be used to introduce certain amounts of 'Injection Gas' to Fossil Fuel well systems that do not have a plunger. These "plungerless" wells have only a gas lift system.

Figure 1:
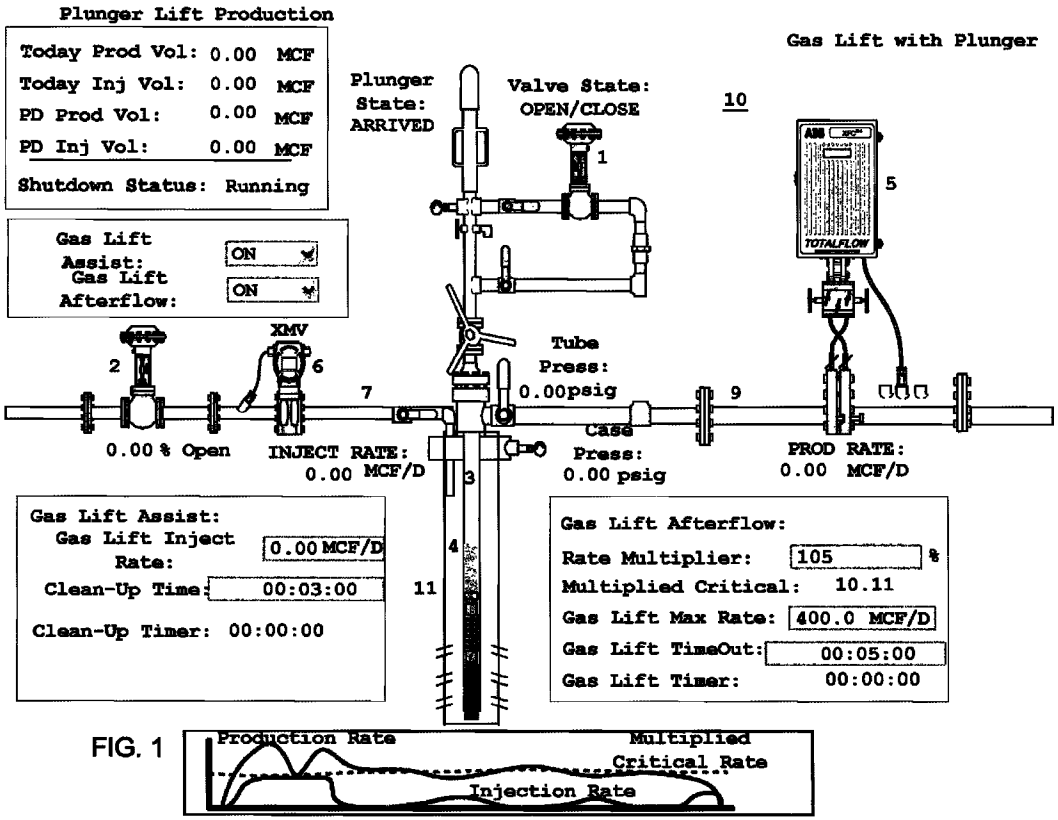
FIG. 1 shows a well with a plunger and the gas lift assist system described herein.
Figure 2:
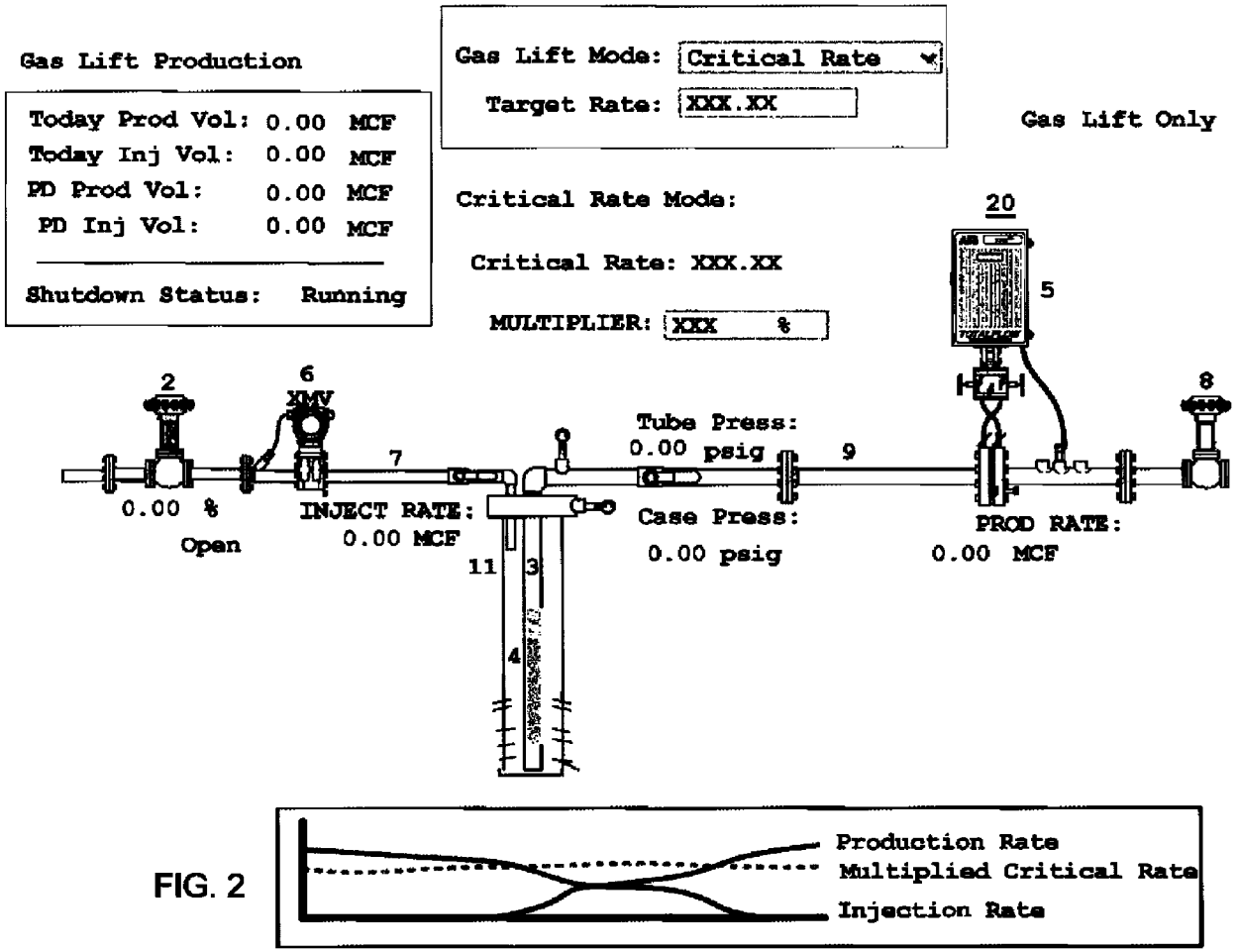
FIG. 2 shows a well without a plunger with the gas lift assist system described herein.

FIGS. 1 and 2, described in detail below, show respectively a Fossil Fuel well system 10 that has a plunger lift system and a Fossil Fuel well system 20 that has only a gas lift system. The same reference numeral is used both figures for identical devices or elements.

As shown in both figures and as is well known in the art, a Fossil Fuel well 11 has a wellbore with production tubing 3 and casing-tubing annulus 4. As is also shown in both figures, both wells have gas lift injection piping 7 that includes an injection gas lift valve 2 and a transmitter 6, which may for example be a multivariable transmitter available from ABB, attached to the piping 7 for monitoring the rate of injection of the lift gas. Injection valve 2 is used to start, stop or control injection of the lift gas into the well 11.

As is further shown in both figures, both wells 11 have production piping 9 that has attached to it an instrument 5, which is a computing device, for monitoring the rate of production of natural gas from the well. Instrument 5 may for example be an ABB Totalflow RTU or flow computer.

Instrument 5 performs the monitoring and control of the attached apparatus using digital and/or analog inputs and outputs. The gas lift gas application is in instrument 5 when instrument 5 is used in the systems of FIGS. 1 and 2. The plunger lift application is also in instrument 5 when the instrument is used in the system of FIG. 1.

The well system of FIG. 1 also has a production plunger lift valve 1 and the well system of FIG. 2 has a master valve 8.

In both of the well systems 10 and 20, the instrument 5 is programmed to calculate a parameter known as "Critical Rate" which is also known as "Critical Velocity". For ease of description, "Critical Rate" is used herein.

The term "Critical Rate" refers to a mathematical calculation commonly used in the natural gas production industry that indicates a gas rate at which the gas has the ability to carry out the liquids in the gas stream. If a well is flowing above the Critical Rate, it can produce the fluids to the surface without any artificial interference such as, for example, Gas Lift or Plunger Lift.

When the well flow rate reaches or falls below the Critical Rate, the fluids begin to fall back to the bottom of the wellbore and reduce the well's ability to produce gas through the accumulated fluid. The Critical Rate is monitored and compared to the rate at which the well produces fossil fuel. This rate is referred to herein as the "Production Rate".

The systems 10 and 20 can respond to any deficiency in the Production Rate by calculating the difference of: Critical Rate minus Production Rate=Overage/Underage.

If this calculation yields a positive number, there is a deficiency in the Production Rate. This difference between the Critical Rate and the Production Rate, known as the "Delta Rate", is used to control the settings of the Injection Valve 2 which opens to the Delta Rate to increase the Production Rate back above the Critical Rate to continue removal of the fluids.

The systems 10 and 20 comprise six or more functions which each have techniques that are implemented in the instrument 5. These functions are described below with reference to the terms defined directly above and the other terms defined directly below and elsewhere in this detailed description.

Figure 3:
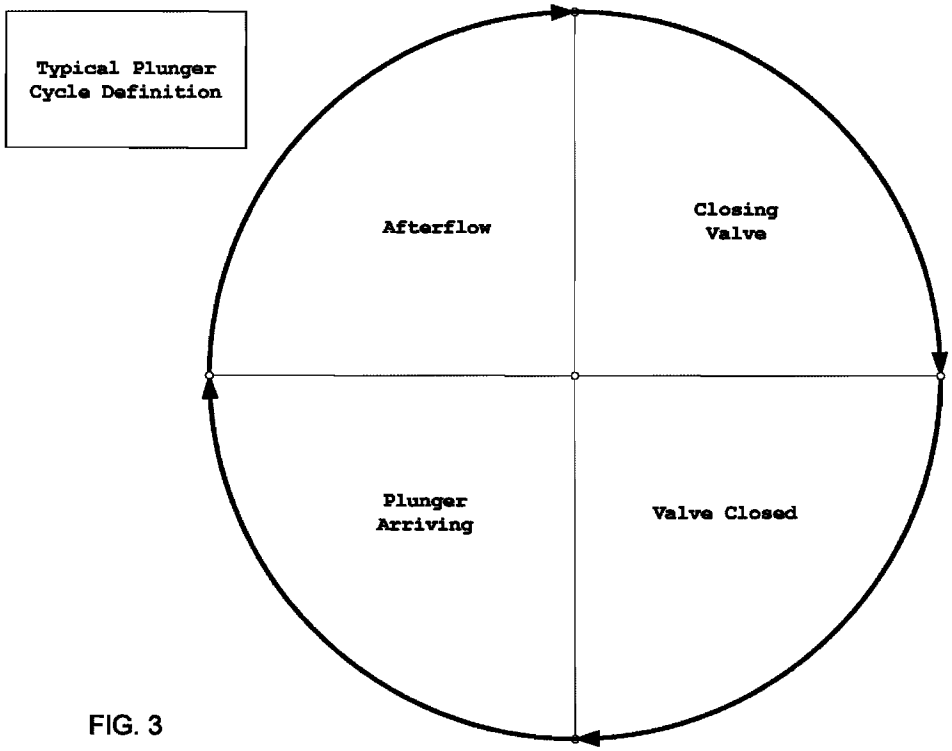
FIG. 3 shows the basic lift cycle for a well that has a plunger without the gas lift system described herein.

PLUNGER LIFT CYCLE: This term refers to the four distinct states or stages that a plunger lift system such as the system shown in FIG. 1 goes through to constitute a 'CYCLE'. These stages are shown in FIG. 3 which is described below.

AFTERFLOW: Term used when using PLUNGER LIFT as the artificial lift mechanism that refers to the period in the PLUNGER LIFT cycle when the PLUNGER has reached the surface equipment (ARRIVAL) and the well if flowing.

MULTIPLIED CRITICAL RATE: This term refers to a CRITICAL RATE that has a multiplier to increase or decrease the CRITICAL RATE. The multiplier is set by the user. The user can find the optimum value for the multiplier by first setting the multiplier high and then backing it down to reach the optimum value. Pressure calculations not yet developed can also be used to assist the user in selecting the optimum value for the multiplier.

MAXIMUM INJECTION RATE: Refers to a user settable maximum rate to inject GAS LIFT GAS based on a calculation which can be software implemented.

MAXIMUM RATE TIME: Refers to a user settable amount of time the MAXIMUM INJECTION RATE would be allowed to be injected.

TUNING: This term refers to an ability to modify the amount of GAS LIFT GAS used in the injection of various states in conjunction with PLUNGER LIFT or GAS LIFT.

TUNING AMOUNT: This term refers to a user settable input for the TUNING used to increase or decrease the amount of injection gas used in various aspects of the system.

As was described above, the plunger lift system 10 in the well 11 of FIG. 1 has a cycle that has four distinct stages as shown in FIG. 3.

Stage 1, shown in the upper right hand quadrant, is defined by the term Closing Valve and refers to the time it takes for the production plunger lift valve 1 to close. The plunger begins to fall to the bottom of the wellbore when the valve 1 starts to close. There is in this stage a delay in the plunger fall as the valve 1 does not instantaneously close at the beginning of this stage. It is assumed that at the end of stage 1 the plunger has reached the bottom of the wellbore. The time duration for stage 1 is an approximation based on the users experience with Fossil Fuel wells.

Stage 2, shown in the lower right hand quadrant, is defined by the term Valve Closed and refers to the time between the expiration of the Closing Valve stage, that is, stage 1, and the beginning of stage 3. The computer implemented techniques associated with this stage are waiting for an "open" condition to become true to cause this stage to end and transition to stage 3. These conditions are either pressure, differential pressure, time or a combination thereof. The techniques are implemented in the Plunger Lift Application that is in the software of the RTU 5. This stage ends when the setpoint is met for any of the pressure, differential pressure or time or combination thereof.

Stage 3, shown in the lower left hand quadrant, is defined by the term Plunger Arriving and refers to the stage after the Valve Closed stage, that is stage 2, when one of the techniques has had its conditions met and causes the PRODUCTION VALVE 1 to open and the PLUNGER is in its transition period from the bottom of the TUBING 3 to the top of the well and the associated surface equipment. The arrival of the PLUNGER at the surface is detected by surface equipment and based on user settable parameters can be classified as FAST, SLOW, NORMAL, or a NON-ARRIVAL. Various parameters can be modified based on this status to affect the operating conditions in an attempt to cause the plunger arrival to fall into the conditions that would be considered NORMAL. The equipment to detect the arrival of the PLUNGER at the surface is not shown in FIG. 1 but is typically a magnetic sensor that is connected to the RTU 5 and sends a pulse to RTU 5 when the PLUNGER arrives at the surface.

Stage 4, shown in the upper left hand quadrant, is defined by the term Afterflow and refers to the stage that occurs after the PLUNGER has arrived at the surface with the well flowing, that is after stage 3, and the techniques in this stage are waiting for a "close" condition to become true to cause this stage to end and therefore end the present Plunger Lift Cycle and start a new Plunger Lift Cycle.

The description below in paragraphs A and B is with reference to the plunger lift system shown in FIG. 1 with the attached gas lift system shown in that figure.

Figure 4:
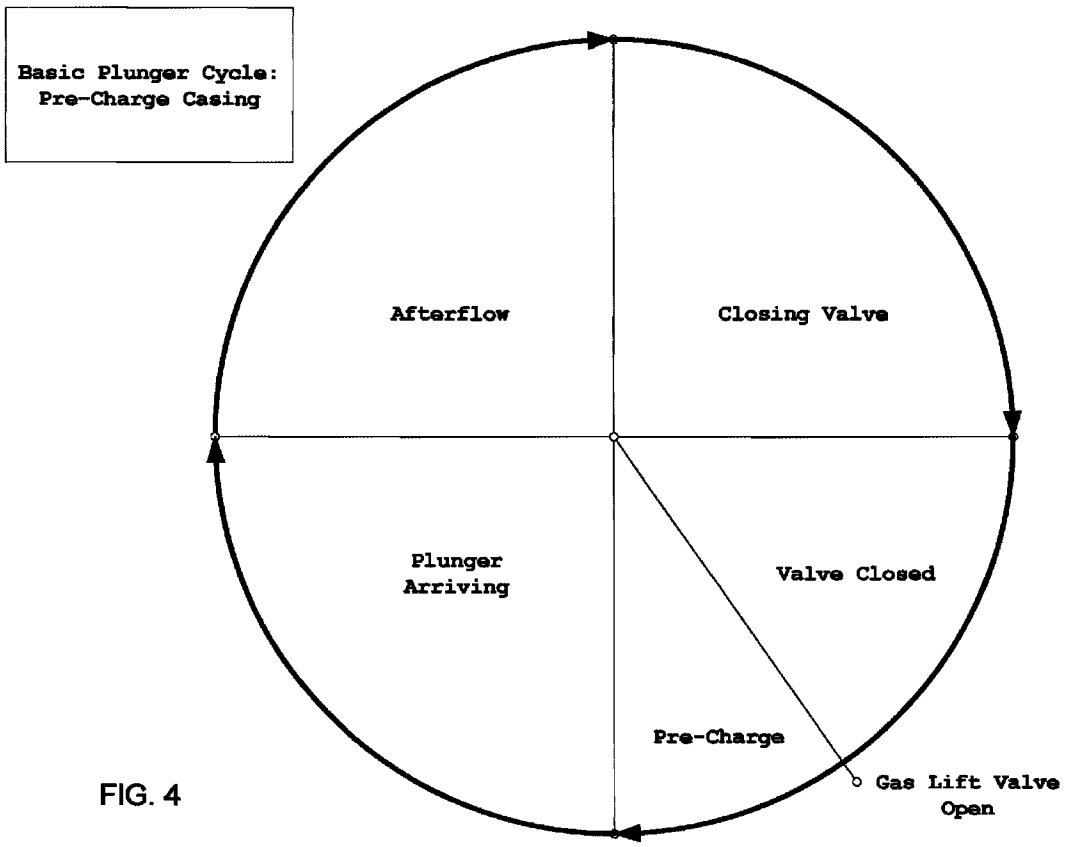
FIG. 4 shows the basic lift cycle for a well that has a plunger with pre-charging of the well casing.
Figure 5:
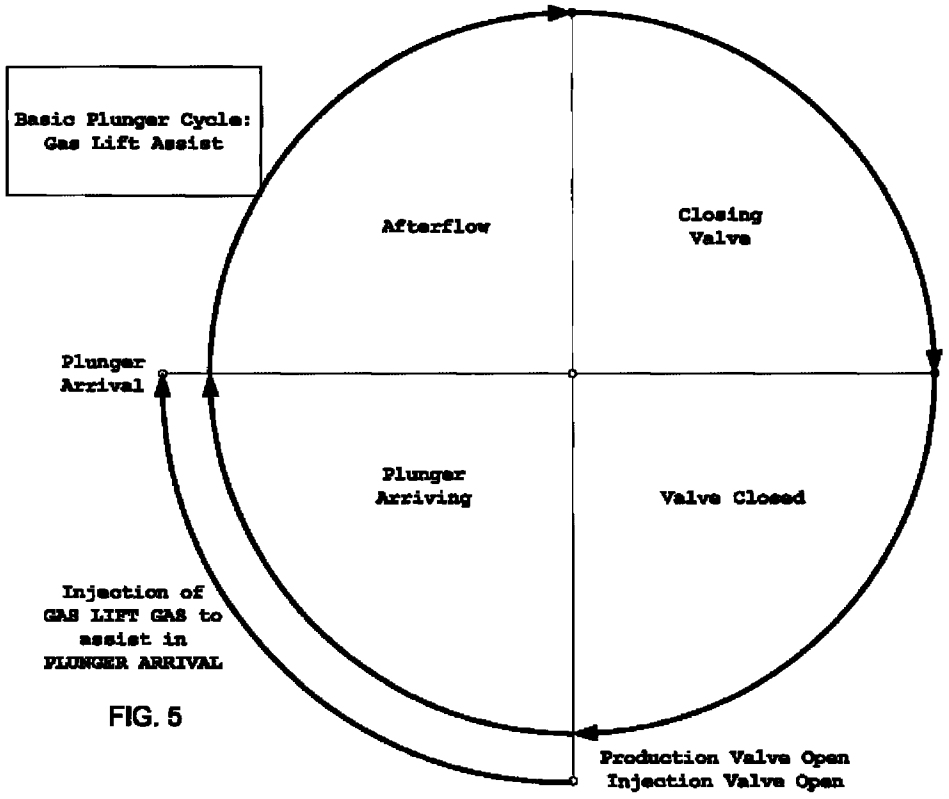
FIG. 5 shows the basic lift cycle for a well that has a plunger with gas lift assist.

A) Gas Lift Gas is injected into the Casing-Tubing annulus 4 of the wellbore by opening the injection gas lift valve 2 ("Injection Valve") in either of two circumstances:

1. as shown in the lower right hand quadrant of the basic plunger cycle: pre-charge casing (Pre-Charge) cycle diagram of FIG. 4, the well is pre-charged by opening the injection gas lift valve 2. The pre-charging is prior to a Plunger Lift cycle which is initiated by the opening of the production plunger lift valve 1. The Injection Valve is opened based on the occurrence of either time or pressure or differential pressure meeting a user defined criteria, for example, when 99% of the set point is met. The opening of the Injection Valve 2 begins inputting Gas Lift Gas into the Casing/Tubing 4 to build gas pressure that will create a larger differential pressure across the Plunger and Fluid.
2. as shown in the basic plunger cycle: gas lift assist (Plunger Assist) diagram of FIG. 5, the Plunger Arriving stage of the plunger cycle is initiated upon the opening of the production tubing valve 1 (see the lower left side quadrant) and Gas Lift Gas is injected into the Casing-Tubing annulus 4. This is a user settable amount of Gas Lift Gas to increase the differential pressure across the Plunger and Fluid Slug to assist the Plunger from the bottom to the top of the well. When the system is first initiated the user sets the amount of Gas Lift Gas based on his or her experience with Fossil Fuel wells. Thereafter with the system running this first setting can be evaluated and changed as necessary.

Figure 6:
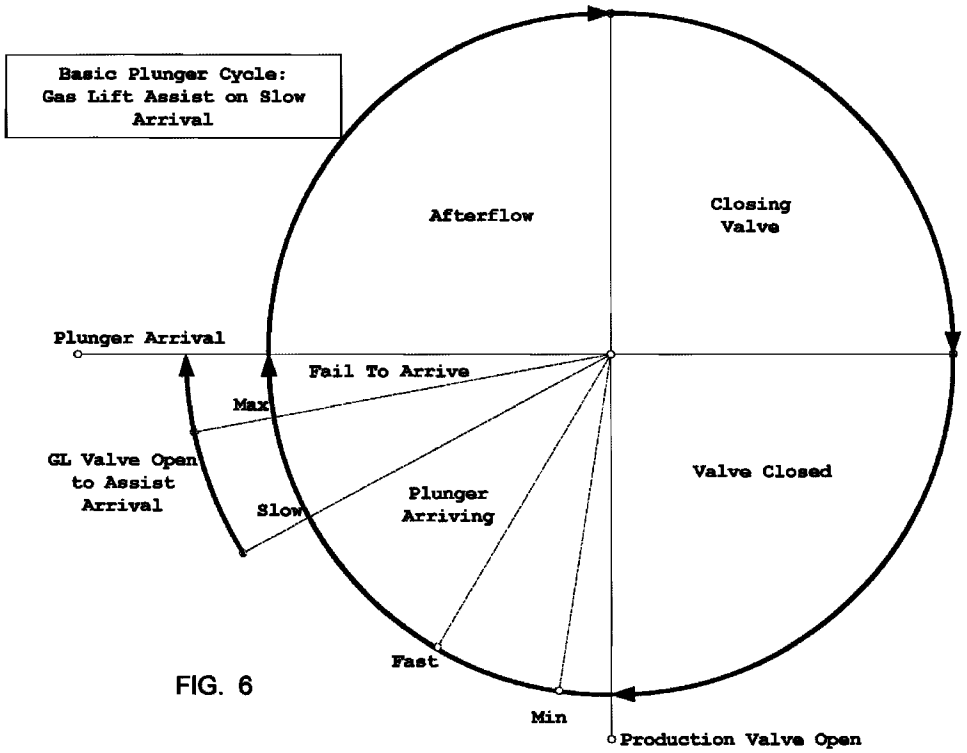
FIG. 6 shows the basic lift cycle for a well that has a plunger with gas lift assist on slow arrival of the plunger.
Figure 7:
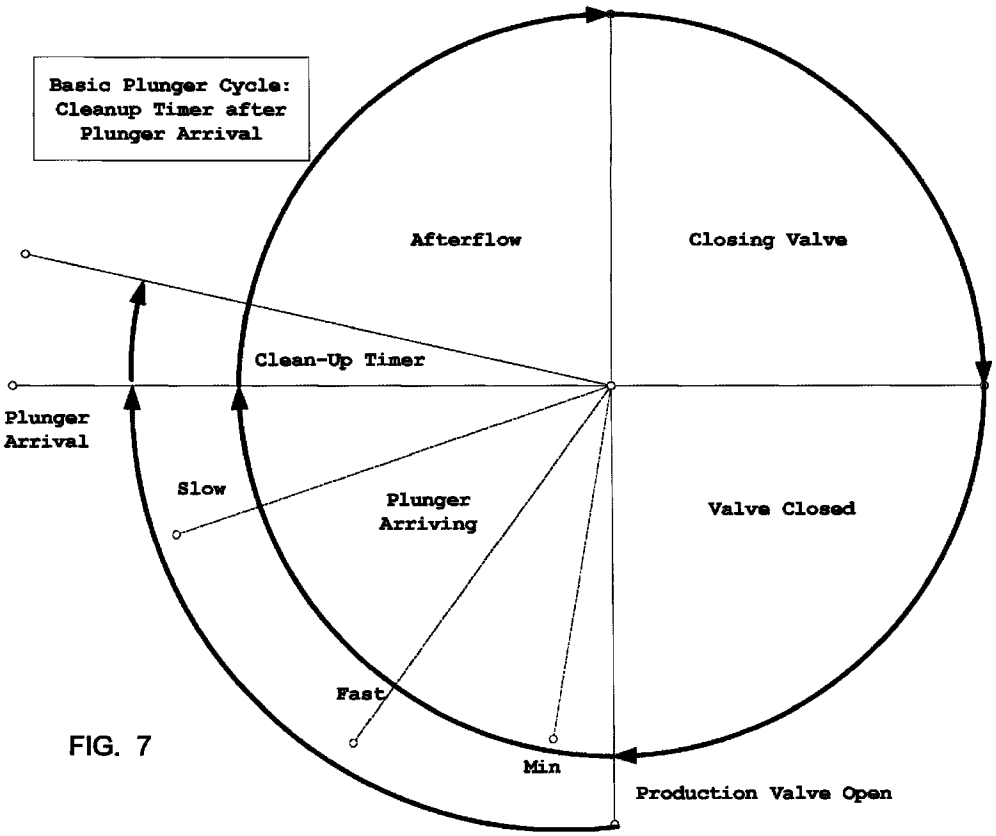
FIG. 7 shows the basic lift cycle for a well that has a plunger with gas lift assist with a cleanup timer after plunger arrival.

The Gas Lift Gas injection is continued until a plunger arrival is deemed by the present technique to be one of two conditions:

1. too slow as shown in the basic plunger cycle: gas lift assist (Slow Arrival Assist) on slow arrival diagram of FIG. 6. The Gas Lift Gas is injected during the Plunger Arriving stage of the plunger cycle if the Plunger Arrival is categorized as slow (a slow Plunger Arrival is defined by the user in the Plunger Lift Application or separately in the Gas Lift application) whereby the Plunger has not arrived by a user defined slow time. The Gas Lift Gas will continue to be injected until either the Plunger arrives at the surface or the Plunger does not arrive by the user defined maximum time allowed for arrival. The technique used in defining the slow and fast timers are to divide the length of the tubing by a 'slow' velocity to derive a 'slow' time of 500 ft/min or less and by a 'fast' velocity to derive a 'fast' time of 850 ft/min or faster. The 500 ft/min and 850 ft/min are subjective plunger travel velocities based on industry accepted practices.
2. the plunger has arrived and gas continues to be injected after plunger arrival until the expiration of a clean-up timer as shown in lower and upper left hand quadrants in the basic plunger cycle: clean-up timer (Clean-Up Timer) after plunger arrival diagram of FIG. 7. Plunger Arrival Clean-Up Timer is a technique in which Gas Lift Gas is continued to be injected after the Plunger has arrived for a user specified amount of time that is based on the user listening to the flow pattern in the well and from that making an educated guess that any fluids that remain in the well have been removed from the well. This technique keeps the production gas rate high enough to continue to remove the trailing fluid from behind the Plunger to create a completely clean wellbore for free gas flow.

B) Using prescribed time intervals to declare a plunger arrival as a Fast Arrival or Slow Arrival, the ability to dynamically modify the amount of Gas Rate applied in the Plunger Assist function to cause the plunger to arrive in a Normal Arrival condition. A Normal Arrival condition is one in which the plunger arrives at the wellhead faster than the calculated 'slow' velocity, but slower than the calculated 'fast velocity'. For example if the well depth is 10,000 ft, then a typical calculation is: Slow is 500 ft/min or less, meaning slow time is 20 minutes or more, fast is 850 ft/min or faster, meaning fast time is 11.75 minutes or less. The 500 ft/min and 850 ft/min are subjective plunger travel velocities based on industry accepted practices.

The description in paragraph C below is with reference to the gas lift only system shown in FIG. 2. As described above, there is no plunger in the well.

C) The operation with no plunger in the well is identical to that described in paragraph A above, with the exception that since a plunger is not existent in the wellbore only the Pre-Charge and Clean-Up Timer functions apply and the Plunger Assist and Slow Arrival Assist functions do not apply.

Figure 8:
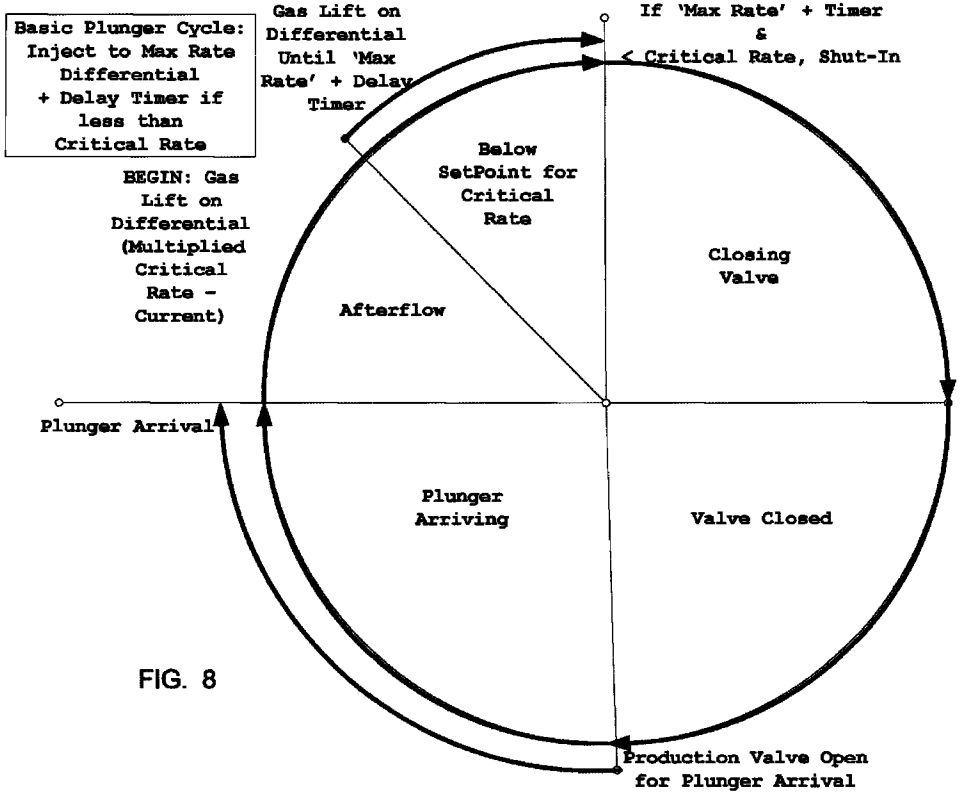
FIG. 8 shows the basic plunger lift cycle for a flowing well that bases the amount of gas to inject on a technique that calculates a 'Critical Rate'.

Paragraph D below describes with reference to FIG. 8 a technique referred to as "Plunger Lift Afterflow Critical Rate Auto Gas Lift" for injecting Gas Lift Gas into the Casing—Tubing annulus 4 of the wellbore during a plunger cycle while the well is flowing but as is described below bases the amount of gas to inject on a technique that calculates a 'Critical Rate'.

D) In Plunger Lift Afterflow Critical Rate Auto Gas Lift the Critical Rate is calculated using the Turner Critical Rate equation plus a multiplier factor to give the Multiplied Critical Rate. The Turner Critical Rate equation is:

$$Q=3.067PVtA/(T+460)Z$$

where:

A (ft2)=3.14 ID2/4*144

T=surface temperature, Deg F

P=surface pressure, psi

A=tubing cross-sectional area

ID=Tubing internal diameter (inch)

Q=mmscf/day z=gas deviation factor and

Vt the terminal velocity or gas critical velocity in ft/sec is determined from the following equation:

$$Vt=1.593S1/4(dl-dg)/dg1/4$$

where:

S=Surface tension between the liquid and gas, dynes/cm

D=density, lb/ft3 (1-liquid, g-gas)

The Production Rate is then subtracted on a periodic basis from the Multiplied Critical Rate to derive a difference which is the Injection rate. This difference is then used as the Gas Lift injection set point or target rate for the Injection Gas that is applied to the system to regulate the amount of gas necessary to return the Production rate to a rate above the 'Multiplied Critical Rate'. If this returning of the Production rate to a rate above the 'Multiplied Critical Rate' is accomplished within an evaluation time limit (Afterflow Timer Limit) which limit is as described below set by the user, the injection valve control rate is set to zero until the Production rate returns to a rate less than the 'Multiplied Critical Rate' at which time the process is repeated. If this returning of the Production rate to a rate above the 'Multiplied Critical Rate' is not accomplished within the evaluation time limit (Afterflow Timer Limit), the control valve rate is set to zero and the control valve is closed. Also the Plunger Lift technique will close the production valve, allowing the plunger to fall to the bottom of the tubing in the wellbore and the cycle will be repeated through various independent plunger lift techniques. The evaluation time limit (Afterflow Timer Limit) is set by the user based on on-site monitoring at the wellhead by listening to the flow until the user does hear any more fluid being produced.

As described above, the INJECTION GAS rate is continually monitored and adjusted until the PRODUCTION rate stays below the MULTIPLIED CRITICAL RATE for a MAXIMUM INJECTION RATE and a MAXIMUM RATE TIME, at which time the technique has been injecting the MAXIMUM INJECTION RATE for a continuous MAXIMUM RATE TIME, the INJECTION VALVE is closed and the PRODUCTION VALVE is closed to begin a new PLUNGER cycle.

The technique described in paragraph 'D' above can also be applied to wells without a plunger lift system to control 'free flow' wells based on 'Critical Rate Injection'. In this application the production rate is monitored versus the 'Critical Rate' (using the Turner Critical Rate equation) plus a multiplier factor. The production rate is subtracted from the critical rate to derive a difference. This difference is then used as a control parameter to the injection valve to regulate the amount of gas necessary to return the production to a rate above the 'Multiplied Critical Rate'.

Figure 9:
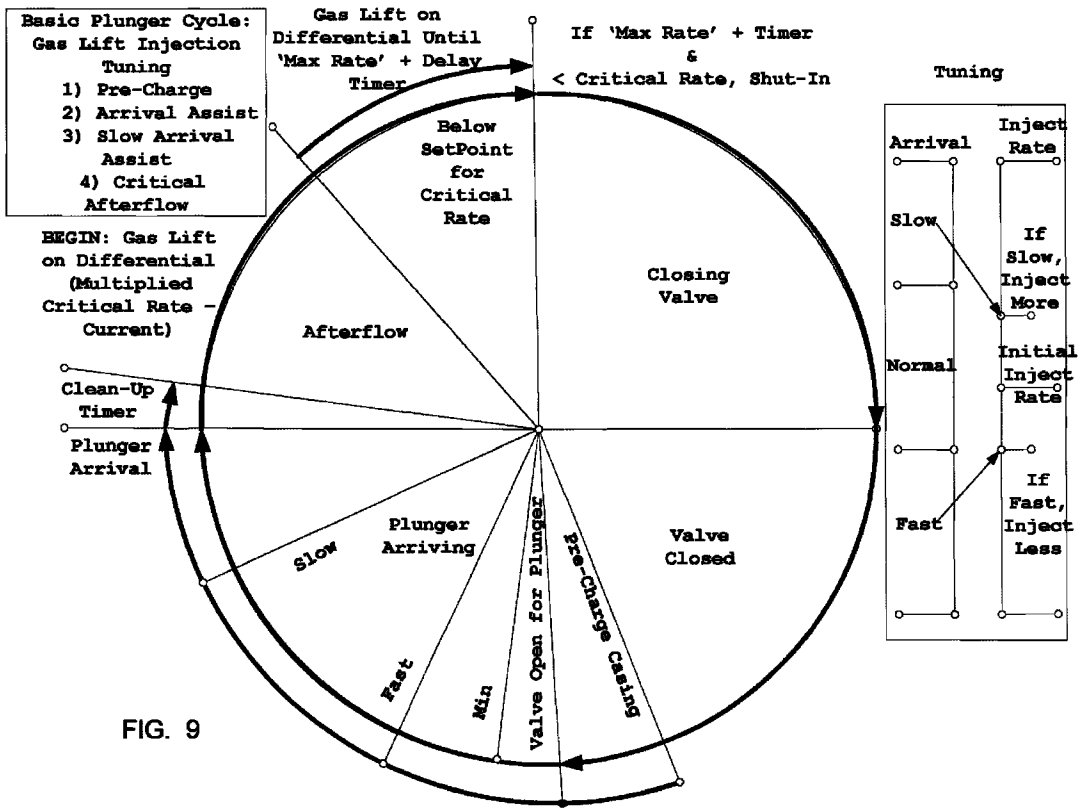
FIG. 9 illustrates a technique known as injection tuning for a plunger lift well.

Referring now to FIG. 9, there is illustrated a technique known as Injection Tuning for a Plunger Lift Well. In this technique, the amount of Gas Lift Gas being injected into the well to PRE-CHARGE, ARRIVAL ASSIST, SLOW ARRIVAL ASSIST, CLEAN-UP INJECT, or CRITICAL RATE inject INJECTION GAS into the system can be modified by a user settable amount based on a PLUNGER ARRIVAL being classified as FAST or SLOW. When using Gas Lift Gas in conjunction with a plunger lift system, the ideal scenario is to have the plunger arrive at a desired velocity for plunger efficiency. Using the Fast/Slow methodology described above and classifying each plunger arrival as Fast/Normal/Slow, the amount of injection gas will either be increased or decreased by a user settable amount to cause the plunger to arrive at the most efficient velocity. The user settable amount is based on trial and error.

Figure 10:
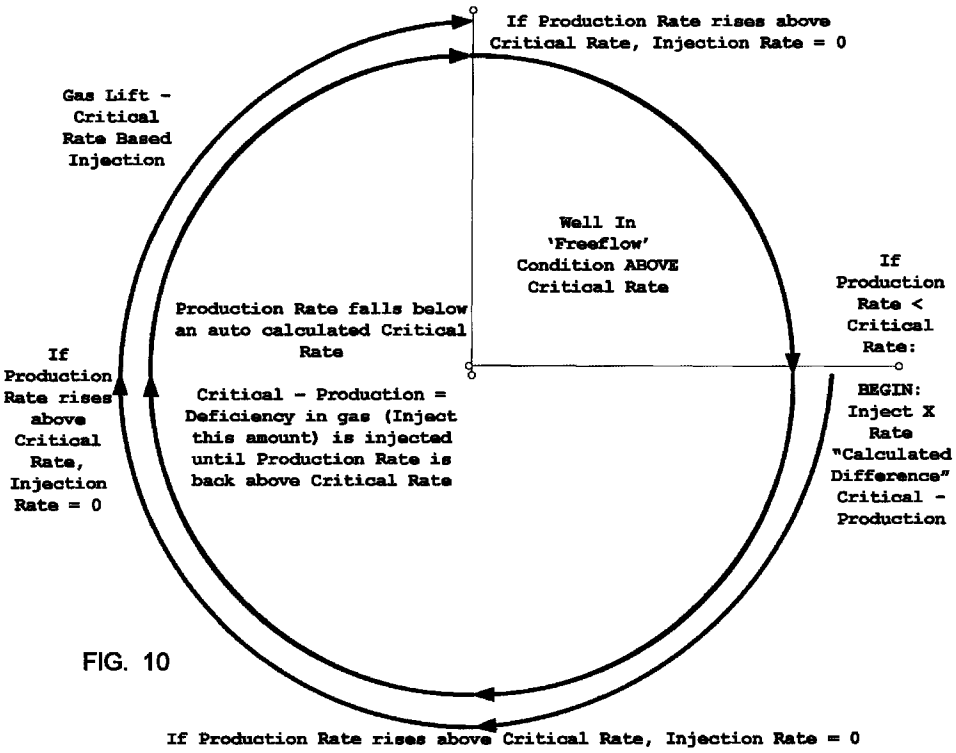
FIG. 10 illustrates a technique known as critical rate gas lift for a non-plunger lift well.

Referring now to FIG. 10, there is illustrated a technique known as Critical Rate Gas Lift on Non-Plunger Lift Well. In this technique, since there is no plunger there is no requirement to specify a fast, slow, min or max arrival time. The Gas Lift Gas is injected into the CASING/TUBING ANNULUS 4 when the PRODUCTION flow rate falls below the MULTIPLIED CRITICAL RATE. The INJECTION rate is a calculated rate by subtracting the PRODUCTION rate from the MULTIPLIED CRITICAL RATE on a periodic basis. The difference is the GAS LIFT injection set point or target rate for the INJECTION GAS that is applied to the system. This INJECTION GAS rate is continually monitored and adjusted until the PRODUCTION rate goes above the MULTIPLIED CRITICAL RATE, at which time the INJECTION VALVE is closed.

Figure 11:
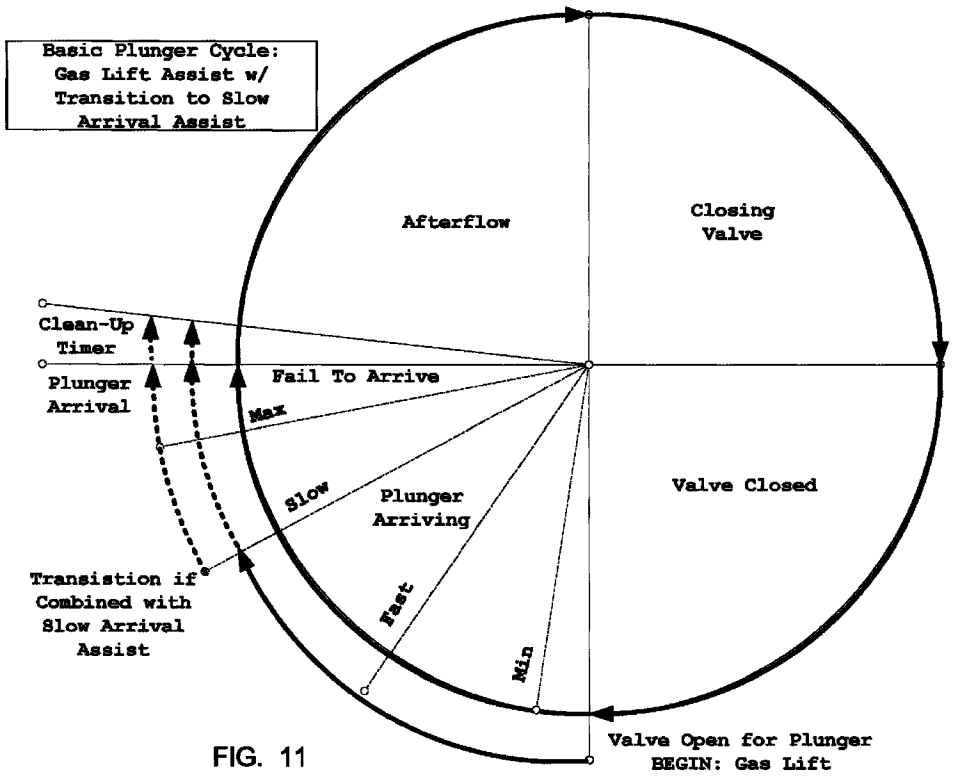
FIG. 11 illustrates a technique known as combined plunger arrival assist transition to slow arrival assist for a plunger lift well.

Referring now to FIG. 11, there is illustrated a technique known as Combined Plunger Arrival Assist Transition To Slow Arrival Assist for a Plunger Lift Well. In this technique, the Gas Lift Gas is injected upon initiating the PLUNGER ARRIVING stage (lower left hand quadrant of FIG. 11) of the plunger cycle. The Slow Arrival Assist rate of Gas Lift Gas is a user settable amount of Gas Lift Gas that increases the differential pressure across the PLUNGER and FLUID SLUG to assist in bringing the PLUNGER from the bottom to the top of the well. For example, the Slow Arrival Assist rate may be twice that of the Arrival Assist rate or any other increase in the rate that is large enough to cause the plunger to continue to arrive at the wellhead. If the PLUNGER has not ARRIVED by the SLOW ARRIVAL time as defined by the user in the plunger lift system (the criteria is the same as that the user uses to define the slow arrival time in the gas lift system) or by a user settable time in the GAS LIFT system, the logic transitions to the INJECTION RATE defined in the SLOW ARRIVAL ASSIST technique illustrated in FIG. 9. The logic of the SLOW ARRIVAL ASSIST USING GAS LIFT is a technique in which Gas Lift Gas is injected during the PLUNGER ARRIVING stage of the plunger cycle if the PLUNGER ARRIVAL is categorized as slow, that is, the plunger has not arrived by a slow time. Slow is defined by the user in the Plunger Lift Application or separately in the GAS LIFT application. In other words, if the plunger hasn't arrived by the Slow Time, then more gas is injected to get the plunger to arrive before the run is declared to be a Late (or Non-Arrival) which is a failure. The Gas Lift Gas continues to be injected until either A) the PLUNGER arrives at the surface or B) the PLUNGER does not arrive by the maximum time allowed for the arrival.

With reference to the lower left hand quadrant of FIG. 11, the logic transitions for this technique are as follows:

1) When the Plunger Valve Opens, ARRIVAL ASSIST GAS LIFT is started by opening the GAS INJECTION VALVE until the ARRIVAL ASSIST RATE is achieved.
2) Plunger ARRIVING—if the plunger is still ARRIVING when the time reaches the SLOW ARRIVAL TIME, then the system transitions to the SLOW ARRIVAL ASSIST technique and RATE, thus increasing the amount of GAS LIFT GAS to increase the differential pressure across the plunger and fluid slug to cause the plunger to continue to arrive.
3) Continue injecting the SLOW ARRIVAL ASSIST RATE until either a) the Plunger arrives, then transition to the CLEAN UP TIMER if in use or b) Plunger Fails to arrive then close both the PLUNGER valve and the GAS LIFT valve to start another PLUNGER CYCLE.

While the detailed description herein and the drawing figures describe and show the dynamically controllable gas lift system for natural gas wells it should be appreciated that the system can also be used for oil wells as it is well known that natural gas wells also produce oil and oil wells also produce natural gas. Thus the term fossil fuel well has been used herein as oil and gas are fossil fuels.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A system for providing lift gas to a well for producing fossil fuel from said well, said well projecting downwardly from a surface and having production tubing and a casing-tubing annulus, said system comprising:

gas lift injection piping connected to said casing-tubing annulus;

a first valve connected to said gas lift injection piping for injecting when said first valve is open said lift gas at a controlled rate into said gas lift injection piping to thereby produce said fossil fuel; and an instrument programmed to use a predetermined criteria to dynamically control said late of injection of said lift gas into said gas lift injection piping, wherein said predetermined criteria includes a critical rate indicative of a flow rate at which a gas in said well carries liquids from said well to said production tubing, said predetermined criteria further including a production rate indicative of a rate at which said well produces fossil fuel, wherein said controllable rate at which said lift gas is injected is dynamically controlled in response to a difference between said critical rate and said production rate, wherein said predetermined criteria further includes terminating injection of said lift gas into said gas lift injection piping based on said production rate staying below said critical rate in response to said lift gas being injected at a predetermined maximum injection rate for a predetermined maximum rate time.

2. The system of claim 1 further comprising a transmitter connected to said gas lift injection piping for monitoring said rate of injection of said lift gas into said gas lift injection piping.

3. The system of claim 1 wherein said instrument is connected to said production tubing.

4. The system of claim 1 wherein said instrument comprises:

program code configurable to use said predetermined criteria to dynamically control said rate of injection of said lift gas into said gas lift injection piping.

5. The system of claim 1 further comprising a plunger in said production tubing.

6. The system of claim 5 further comprising a second valve connected to said production tubing, said lift gas injected at said dynamically controlled rate of injection into said gas lift injection piping when both said first and second valves are open to cause said plunger to arrive at said surface.

7. The system of claim 6 wherein said dynamically controlled rate of injection of said lift gas is changed to increase said rate of injection when said plunger has not arrived at said surface within a first predetermined period of time measured from said opening of said first and second valves and to decrease said rate of injection when said first and second valves are next both opened and said plunger has arrived at said surface within a second predetermined period of time measured from said opening of said first and second valves that is indicative that said plunger has arrived at said surface too soon.

8. The system of claim 1, said system further comprising a second valve connected to said production tubing, said lift gas injected at said dynamically controlled rate of injection into said gas lift injection piping when both said first and second valves are open, wherein said critical rate of said predetermined criteria includes a multiplied critical rate, wherein said controllable rate is dynamically controlled in response to a difference between said multiplied critical rate and said production rate.

9. An instrument for attachment to production tubing in a gas lift system for providing lift gas to a well for producing fossil fuel, said well also having a casing-tubing annulus, lift gas injection piping connected to said casing-tubing annulus, and a first valve connected to said gas lift injection piping for injecting said lift gas at a controlled rate into said gas lift injection piping, said instrument comprising:

program code usable by said instrument, said program code comprising:

code configurable to use a predetermined criteria to dynamically control said rate of injection of said lift gas into said gas lift injection piping when said well is producing said fossil fuel; and wherein said predetermined criteria includes a critical rate indicative of a flow rate at which a gas in said well carries liquids from said well to said production tubing, said predetermined criteria further including a production rate indicative of a rate at which said well produces fossil fuel, wherein said controllable rate at which said lift gas is injected is dynamically controlled in response to a difference between said critical rate and said production rate, wherein said predetermined criteria further includes terminating injection of said lift gas into said gas lift injection piping based on said production rate staying below said critical rate in response to said lift gas being injected at a predetermined maximum injection rate for a predetermined maximum rate time.

10. The instrument of claim 9 wherein said well projects downwardly from a surface and said well further has production tubing with a plunger therein and a second valve connected to said production tubing, said program code further comprising code configurable to inject said lift gas at said dynamically controlled rate of injection into said gas lift injection piping when both said first and second valves are open to cause said plunger to arrive at said surface.

11. The instrument of claim 10 wherein said program code further comprises code configurable to increase said dynamically controlled rate of injection of lift gas when said plunger has not arrived at said surface within a first predetermined period of time measured from said opening of said first and second valves and to decrease said rate of injection when said first and second valves are next both opened and said plunger has arrived at said surface within a second predetermined period of time measured from said opening of said first and second valves that is indicative that said plunger has arrived at said surface too soon.

12. The instrument of claim 9 wherein said well further has production tubing and a second valve connected to said production tubing, said program code further comprising code configurable to inject said lift gas at said dynamically controlled rate of injection into said gas lift injection piping when both said first and second valves are open, and said critical rate of said predetermined criteria includes a multiplied critical rate, wherein said controllable rate is dynamically controlled in response to a difference between said multiplied critical rate and said production rate.

13. A method for injecting lift gas at a controllable rate into a fossil fuel well, said well having gas lift injection piping, production tithing and a control instrument with configurable code connected to said production tubing, said method comprising:

configuring said control instrument with a predetermined criteria that causes said instrument when said well is producing said fossil fuel to dynamically control said controllable rate at which said lift gas is injected into said gas lift injection piping, wherein said predetermined criteria includes a critical rate indicative of a flow rate at which a gas in said well carries liquids from said well to said production tubing, said predetermined criteria further including a production rate indicative of a rate at which said well produces fossil fuel, wherein said controllable rate at which said lift gas is injected is dynamically controlled in response to a difference between said critical rate and said production rate, wherein said predetermined criteria further includes terminating injection of said lift gas into said gas lift injection piping based on said production rate staying below said critical rate in response to said lift gas being injected at a predetermined maximum injection rate for a predetermined maximum rate time.

14. The method of claim 13 wherein said well projects downwardly from a surface and further has a first valve connected to said gas lift injection piping, a plunger in said production tubing and a second valve connected to said production tubing, said method further comprising:

configuring said control instrument to inject said lift gas at said dynamically controlled rate of injection into said gas lift injection piping when both said first and second valves are open to cause said plunger to arrive at said surface.

15. The method of claim 14 further comprising:

configuring said control instrument to increase said dynamically controlled rate of injection of lift gas when said plunger has not arrived at said surface within a first predetermined period of time measured from said opening of said first and second valves and to decrease said rate of injection when said first and second valves are next both opened and said plunger has arrived at said surface within a second predetermined period of time measured from said opening of said first and second valves that is indicative that said plunger has arrived at said surface too soon.

16. The method of claim 13 wherein said well further has a first valve connected to said gas lift injection piping and a second valve connected to said production tubing, said method further comprising:

configuring said control instrument to inject said lift gas at said dynamically controlled rate of injection into said gas lift injection piping when both said first and second valves are open; and said critical rate of said predetermined criteria includes a multiplied critical rate, wherein said controllable rate is dynamically controlled in response to a difference between said multiplied critical rate and said production rate.

* * * * *